United States Patent [19]

Wohlfahrt

[11] 4,440,297

[45] Apr. 3, 1984

[54] SELLING PACKAGE FOR SMALL PIECES ESPECIALLY FOR CHRISTMAS DECORATIONS

[76] Inventor: Harold Wohlfahrt, Herrngasse 2, 8803 Rothenburg ob der Tauber, Fed. Rep. of Germany

[21] Appl. No.: 379,759

[22] Filed: May 19, 1982

[30] Foreign Application Priority Data

Jan. 30, 1982 [DE] Fed. Rep. of Germany ... 8202317[U]

[51] Int. Cl.[3] ..... B65D 25/54; B65D 81/02

[52] U.S. Cl. ..... 206/45.31; 206/45.14; 206/583; 206/806

[58] Field of Search ..... 206/45.31, 45.19, 45.14, 206/45.34, 806, 583

[56] References Cited

U.S. PATENT DOCUMENTS

| | | | |
|---|---|---|---|
| Re. 21,592 | 10/1940 | Addis et al. | 206/45.19 |
| 348,611 | 9/1886 | Beatty | 206/45.31 |
| 1,887,270 | 11/1932 | Krieg | 206/45.19 |
| 2,648,156 | 8/1953 | Colgate | 206/45.31 |
| 3,752,301 | 8/1973 | Bluemel | 206/583 |
| 3,853,220 | 12/1974 | Luray | 206/583 |

FOREIGN PATENT DOCUMENTS

| | | | |
|---|---|---|---|
| 827346 | 1/1979 | U.S.S.R. | 206/583 |

*Primary Examiner*—William T. Dixson, Jr.
*Assistant Examiner*—Brenda J. Ehrhardt
*Attorney, Agent, or Firm*—Irving M. Weiner; Pamela S. Burt; John L. Shortley

[57] ABSTRACT

A box for displaying and selling small articles such as Christmas ornaments and the like. The box includes a lower part having a side panel which forms a base for displaying the box in an upright position on one of its sides, and an opposite panel provided with a slit for receiving and supporting a hanging member of an article to be displayed in the box such that the article is suspended above the base panel in freely swinging relation thereto. The box further includes a lid having a window-like opening for viewing an article within the box.

8 Claims, 3 Drawing Figures

SELLING PACKAGE FOR SMALL PIECES ESPECIALLY FOR CHRISTMAS DECORATIONS

TECHNICAL FIELD

This invention relates to the display and selling of packages for small articles especially for Christmas decorations, such as little angles or little toys of many different kinds. Usually, such articles if they are used as Christmas tree decorations, have a tab or loop to hang them on a tree. The packing of such small pieces often is somewhat difficult because a single package style may be used for several different toys, or ornaments, or other articles, and a box-like package containing one article will not be readily distinguishable from another containing a different article. Further, a display of the contents of the box is not possible.

SUMMARY OF THE INVENTION

Such difficulties are overcome by the instant invention. According to the invention there is constructed a displaying and selling package or box which facilitates packing of the small pieces and at the same time provides a good display of the packaged articles. This is attained by forming the lower part of the box-like container so that it can serve as a base for display purposes and providing it with a support in its upper top, with respect to the base, from which the offered product can be suspended using an available tab, such as a thread or a loop attached to the product, and by providing a lid with a window which makes the support article in the lower part of the box visible from the outside.

The lid of the box preferably forms a frame around the window which is provided with pictorial matter in the form of paintings, ornaments or something similar, which will complement the offered product.

To protect the packaged article from the environment, the window opening in the lid of the box can be covered with a transparent film or a stiff transparent enclosure. The outline of the window opening is adapted to the form and the measurement of the offered product. There can also be provided an insert suitable for the form of the offered article, which can be provided with pictures, ornamentation or the like, and which can be placed in the lower part of the box to serve as a background for the article displayed in the box. The inserts are changeable so that the box can desirably be used for a number of different objects, and for different seasons of the year.

Another feature of the invention is that the box is provided with a side or section which serves as a stand which makes it possible to always place the displaying and selling package in the right position.

The box lid is arranged to effectively form an opposing support for the available tab or loop of the product, or it can be provided with such a tab to engage a loop or the like so that in either event there is a means for securing the product tab or loop to maintain the desired position of the offered or packaged product inside the box.

The concept of the invention allows many different possibilities of execution. One possibility is represented in the enclosed drawing which shows a selling package in an open condition with a product supported therein.

DETAILED DESCRIPTION OF PREFERRED EMBODIMENTS

Figure 3:
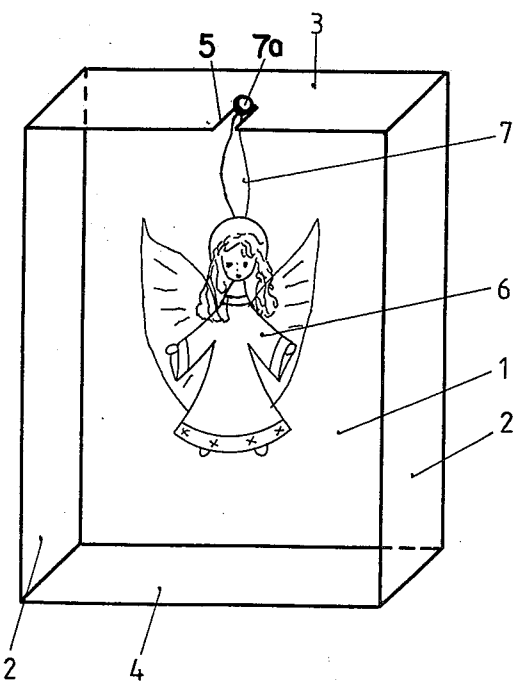
FIG. 3 is a perspective elevational view of an open box showing a product supported therein.
Figure 2:
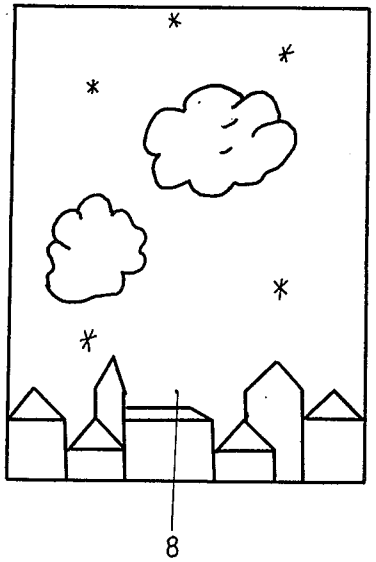
FIG. 2 is a front elevational view of a display card or insert.

With reference to FIG. 3, the lower part of the box (1) is provided with side panels 2, 2, 3 and 4 attached to the box bottom as is usual for selling packages. The box can stand upright on panel 4, and when so positioned contains in the upper panel (3) a slit (5) which is open up to the upper edge of the box. The product 6, in this case an ornament, has a substantially flexible loop 7 formed of string, light wire, or the like which is useable for suspending the ornament from a Christmas tree or the like. The loop is provided with a knob-like portion, tab, or member *7a*. This can be formed in the closing of the loop by tieing or otherwise twisting the loop upon itself, or it can be a special element such as a thin metal or plastic piece which can be clamped to or otherwise attached to the loop. The knob *7a* is broader than the slit 5, while the loop 7 itself is thinner than the slit, and thus when the loop 7 is inserted to the position shown, the knob *7a* will maintain the loop in position in the box. In the embodiment illustrated, the article (6) is pushed into the box bottom from the open front top with the aid of tab thread (7), so that with the box standing on panel 4 the ornament hangs up in a free swinging manner at the right height.

To achieve a pleasing representation of the offered product (6) or to show more pictorially its execution and form, there can be inserted a stiff background display card or papar (8) which bears pictures or inscriptions or similar material. The card 8 is placed in the lower part of the box (1), and is dimensioned so as to be frictionally held in position, just lying on the bottom of the box. On the other hand, adhesive can be used to secure the card.

Figure 1:
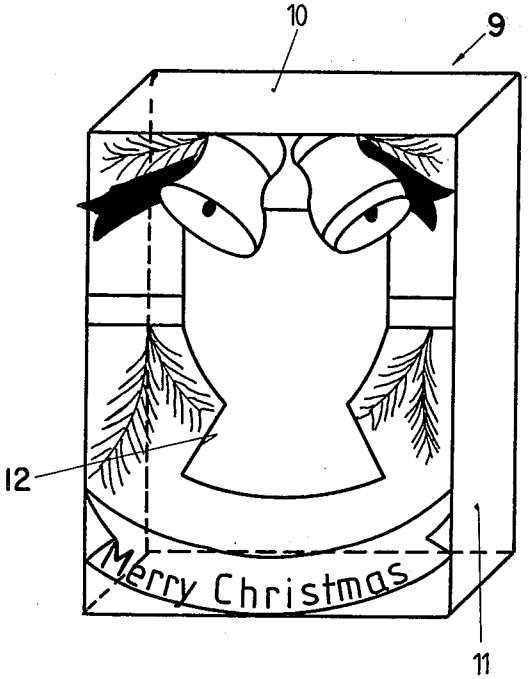
FIG. 1 is a perspective elevational view of a box lid having a display window according to the invention.

The lid 9 of the box shown in FIG. 1 is provided in the same manner with side panels (10, 10 and 11, 11), which surround the window opening (12). Window 12 corresponds in size to the size and position of the suspended article (6). When the lid 9 is put on, the product is clearly visible through the window opening (12). The part of the lid which frames the opening can also be so shaped and provided with pictures, ornaments or the like, as to enhance the pictorial impression of the suspended article (6). The lid, the upper part of the box (9) and also the inserted card (8) can be painted or printed with an appropriate inscription, so that the whole package can be used as a congratulatory message, for example.

To protect the article (6) properly, the window opening in the lid 9 of the box can be covered with a transparent film, or an inserted card or the like of transparent material can be placed in or over the open top of the box.

The box cover or lid is sized with respect to the bottom so as to tightly fit the latter and extend downwardly toward the base of the box sufficiently to frictionally contact the knob *(7a)* and fasten it between the box bottom and its cover. Thus, the top panel (10) passes tightly over the knob *(7a)* in putting the cover (9)

of the box on the lower part of the box (1), and thereby forms an opposing support for the loop of the article which secures the position of the loop and the article.

In another form of the invention the box top 9 can have a slit similar in form to a slit (5) which will pass beneath the knob (*7a*) and serve to also secure the figure in position. The slit in the cover can be of a depth from the cover edge so that the knob will bear against the ends of both slits and be fastened in the position shown in FIG. 3.

This display and selling package according to the invention can be used for example, for packaging or offering Christmas decorations, such as angels, Father Christmas or Santa Claus figures, little toys, or the like, or on the occasion of Easter, for Easter bunnies, Easter eggs and so on. The respective parts (8,9), which can be varied according to the feast or holiday, are used as supports for the painting and inscription. Further, the whole package can be used as a mailing package by using a special clasp for securing the cover to the box or by taping or the like. The bottom of the box can be used for addressing the package and applying postage.

I claim:

1. A box for displaying and selling Christmas decorations or the like products, wherein:

said box has a lower part including a side panel which forms a base for displaying said box in an upright position on one of its sides;

a second panel opposite said base panel;

said second panel having a support means receiving and supporting a substantially flexible hanging member of an article to be displayed and the attached article;

said box being dimensioned that said hanging tab is received in said support means so as to suspend said article above said base panel in freely swinging relation thereto when said box is in said upright position; and a lid having a window-like opening for viewing an article within said box.

2. The displaying and selling box of claim 1, wherein:

said lid of said box forms a frame around said window-like opening said frame being provided with a background picture for said product.

3. The displaying and selling box of claims 1 or 2, wherein:

said window-like opening is closed by a transparent element.

4. The displaying and selling box of claim 3, wherein:

said window-like opening is adapted to the form and size of the product to be displayed therein.

5. The displaying and selling box of claim 3, including:

a decorative insert, formed to the size of said lower part of said box and adapted to be retained therein to serve as a background for a product contained in said box.

6. The displaying and selling box of claim 1, wherein:

said support means comprises a slit in said second panel extending inwardly from the open end of said lower part of said box;

said slit being of a width greater than the thickness of said hanging member attached to said article to be displayed but being of a width less than a knob affixed to said hanging member of said article to be displayed, whereby said hanging member may be passed inwardly of said slit with the knob thereof maintained to the outer side of said slit containing panel and said article to the inner side.

7. The displaying and selling box of claim 6, wherein:

said lid includes a slit formed complementarily to said slit in said panel and extending inwardly of one edge of said lid whereby the latter slit will extend lengthwise of the former slit when said box lid is placed on said lower part of said box with a knob of said article to be displayed secured on the outer side of said lid.

8. The displaying and selling box of claim 6, wherein:

said lid closely fits said lower part of said box, whereby a knob of said article to be retained in said box will be wedged between said box lid and said lower part of said box.

* * * * *